US006572027B1

(12) United States Patent
Pilesi et al.

(10) Patent No.: US 6,572,027 B1
(45) Date of Patent: Jun. 3, 2003

(54) CONCRETE RAILROAD TIE TWO-PIECE INSULATOR SPACER AND FASTENING SYSTEM

(75) Inventors: William D. Pilesi, Monroeville, PA (US); Richard A. Burke, Wheelersburg, OH (US)

(73) Assignee: KSA Limited Partnership, Pittsburgh, PA (US)

( * ) Notice: Subject to any disclaimer, the term of this patent is extended or adjusted under 35 U.S.C. 154(b) by 0 days.

(21) Appl. No.: 10/118,824

(22) Filed: Apr. 9, 2002

(51) Int. Cl.[7] ..... E01B 13/00
(52) U.S. Cl. ..... 238/310
(58) Field of Search ..... 238/310, 315, 238/321, 336, 338, 343, 351

(56) References Cited

U.S. PATENT DOCUMENTS

| | | | | |
|---|---|---|---|---|
| 3,576,293 A | 4/1971 | Landis | ..... | 238/287 |
| 3,784,097 A | 1/1974 | Landis | ..... | 238/310 |
| 3,831,842 A | 8/1974 | Tamura | ..... | 238/349 |
| 4,216,904 A | 8/1980 | Vivion | ..... | 238/25 |
| 4,967,954 A | 11/1990 | Von Lange | ..... | 238/310 |
| 6,027,034 A | 2/2000 | Demmig et al. | ..... | 238/382 |
| 6,045,052 A | 4/2000 | Besenschek | ..... | 238/382 |
| 6,343,748 B1 | 2/2002 | Pilesi et al. | ..... | 238/310 |

OTHER PUBLICATIONS

Pandrol Rail Fastenings Ltd., "Concrete Sleeper Manufacture: Method Statement for the Assembly of Fastclip Sleepers," Brochure, England 1998.

*Primary Examiner*—S. Joseph Morano
*Assistant Examiner*—Robert J. McCarry, Jr.
(74) *Attorney, Agent, or Firm*—Reed Smith LLP

(57) ABSTRACT

A system for securing a rail to a concrete railroad tie employing a two-piece insulator spacer that improves the resistance of the insulator spacer to the crushing deterioration induced by laterally-directed compressive forces during service. The insulator spacer comprises an upper member and a post member. The post member is subjected to high compressive loads in service and consists of composite material that is sufficiently electrically insulating to operably electrically insulate the rail with which the insulator spacer is in contact from the shoulder insert with which the improved insulator spacer is also in contact.

81 Claims, 5 Drawing Sheets

CONCRETE RAILROAD TIE TWO-PIECE INSULATOR SPACER AND FASTENING SYSTEM

FIELD OF THE INVENTION

The invention relates to fastening systems for securing rails to concrete railroad ties. In particular, the invention relates to fastening systems having two-piece insulator spacers. The invention also relates to the two-piece insulator spacers. The invention further relates to methods of securing a rail to a concrete railroad tie using such two-piece insulator spacer and to methods of retrofitting a railroad system having a rail insulated from a shoulder insert mounted in a concrete railroad tie using such a two-piece insulator spacer.

BACKGROUND OF THE INVENTION

Description of the Prior Art

Concrete railroad ties have been used in modern railroads for many years. One of the various fastening systems that have been developed for securing rails to concrete railroad ties is shown in FIG. 1. At each rail seat area 2 where a rail 4 is to be fastened to concrete railroad tie 6, cast iron shoulder inserts 8, 10 are provided opposing each other on the field and gauge sides of the rail seat area 2, respectively. Each of the shoulder inserts 8, 10 is permanently mounted within the concrete railroad tie 6 at a position directly adjacent to the rail seat area 2. The rail 4 is mounted between the two shoulder inserts 8, 10 and upon an elastomeric tie pad 12 that spans the rail seat area 2 between the two shoulder inserts 8, 10. An insulator spacer 14 is placed adjacent to and abutting the base or toe 16 of rail 4 between rail 4 and each shoulder insert 8, 10. Each insulator spacer 14 has an inner surface that is adapted to conform to the shape of the vertical and sloping lateral faces of rail base 16. A retaining clip 18, that is attached to a shoulder insert 8, 10 by way of being inserted through a longitudinal receiving hole 20 in a shoulder insert 8,10, presses upon the outer surface 22 of the corresponding insulator spacer 14 to rigidly secure rail 4 to concrete railroad tie 6.

In this system, the tie pad 12 and the insulator spacers 14 act to electrically insulate the rail 4 from its companion rail 4 and from the ground. Such electrical insulation is necessary to permit the rails 4 to be used to conduct electrical signals for monitoring and controlling the progress of the trains that run upon them.

However, electrical insulation is not the only important property that an insulator spacer 14 must possess. The passage of a train upon the rails 4 subjects the rails 4 to complex patterns of horizontal and vertical forces and vibrations. These forces are transmitted from the rails 4 to the fastening systems which retain the rails 4 to the railroad ties. These forces are particularly high on curved portions of the track where the laterally-directed compressive force on a shoulder insert 8, 10 may exceed 28,000 pounds (124,550 N). Because the insulator spacers 14 are sandwiched between the rails 4 and the shoulder inserts 8, 10, these forces subject the insulator spacers 14 to high compressive loads. To combat these loads, insulator spacers 14 have been made of a monolithic, durable insulating material having high compressive strength, such as 6-6 nylon. However, in service, the repeated exposure of the insulator spacers 14 to high compressive loads causes the insulator spacers 14 to deteriorate over time by way of crushing and abrasion. This deterioration occurs mainly in the portion of the insulator spacer 14 that is compressed between the shoulder insert 8, 10 and the vertical or post face 17 of the rail base 16, a portion that is referred to as the post. As the deterioration progresses, the rail 4 becomes able to move, thus causing wear and fatigue on the fastening system components and the concrete railroad tie 6 and compromising the safety of train travel upon the rail 4. Thus, the deterioration makes it necessary to spend time and money to inspect the insulator spacers 14 for wear and to remove and replace worn insulator spacers 14.

It is to be understood that what is being referred to herein by the term insulator spacer is also referred to by those skilled in the art by the simple generic term insulator. However, the term insulator spacer is more descriptive as it brings to mind both the mechanical and electrical functions of the component.

These deterioration problems in their invention which is described in Pilesi et al, U.S. Pat. No. 6,343,748, which is incorporated herein by reference as if set forth herein in its entirety. That invention relates to improved insulator spacers and fastening systems and methods utilizing those insulator spacers. Each of those insulator spacers has one or more composite inserts positioned in its post so that the shoulder insert and the rail each contact the composite insert. Each such composite insert comprises a high compressive strength, electrically insulating material sandwiched between tough outer layers to provide electrical insulation between the rail and the shoulder insert. By locating one or more such composite inserts in the conventional durable, high compressive strength insulating material, e.g., 6-6 nylon, of the insulator spacer's post, the design of the inventors' prior invention placed wear resistant, durably tough material in contact with the adjacent surfaces of the rail and the shoulder insert thereby enhancing the mechanical lifetime of the improved insulator spacer of which it is a part.

In addition to possessing good electrical insulation and resistance against deterioration due to crushing and abrasion, an insulator spacer also needs to have the ability to flex appropriately with the applied loads it encounters in service. Two main flexural components may be identified: (1) a linearly-directed horizontal component; and (2) a rotationally-directed vertical component. These are depicted in FIG. 2B respectively by vector arrows X and Y. The linearly-directed horizontal component X compresses the post area of the insulator spacer 24 between the post areas of the rail 4 and shoulder insert 8, 10 causing the post area of the insulator spacer 14 to flex compressively along the direction of the horizontal component X. The rotationally-directed vertical component Y, which is produced by the vertical distortion of the base or toe 16 of rail 4, causes the toe 23 of the insulator spacer to flex upward and the body of the insulator spacer 24 to attempt to rotate around its axis Z. In a conventional, monolithic insulator spacer, the response of the insulator spacer to the vertical component Y conflicts with the compressive flex of the post area of insulator spacer caused by the horizontal component X and results in detrimental stresses in the conventional insulator spacer.

An insulator spacer's ability to flex is to a significant degree governed by the elastic modulus of its material of construction. The elastic modulus equals the quotient of the applied stress divided by the resulting elastic strain. The elastic modulus is a measure of a material's stiffness such that the higher the elastic modulus of the material, the stiffer the material is. The optimum elastic modulus value for an insulator spacer depends on the application in which it is used. In some applications, the elastic modulus value that best accommodates the horizontal component X may be different from that which best accommodates the vertical component Y. However, the monolithic structure of conventional insulator spacers militates against, if not completely precludes, optimizing the elastic modulus for both the horizontal component X and the vertical component Y.

SUMMARY OF THE INVENTION

The present invention overcomes the problems associated with prior art systems and improves upon the inventors' own prior invention. The present invention provides an improved fastening system for securing a rail to a concrete railroad tie that employs an insulator spacer comprising a two-piece design consisting of an upper member and a post member. The upper member is pressed upon and thereby fixed in place by the retaining clip that is inserted into a shoulder insert to secure the rail to the concrete tie. The post member comprises substantially all of the post area of the two-piece insulator spacer, although it may extend beyond the post area.

The post member nests into a cavity in the upper member so as to be constrained thereby from migrating laterally and vertically during service. Preferably the post member nests loosely within the cavity, because a loose fit between the two pieces of the two-piece insulator spacer permits independent flexure of the upper member and the post member in response to the loads encountered during service and eliminates the internal stresses caused by the interplay of the linearly-directed horizontal component X and the rotationally-directed vertical component Y of flex described above. Furthermore, because the horizontal component X is primarily associated with the post member and the vertical component Y is primarily associated with the upper member, the elastic moduli for the two-piece insulator spacer can be optimized for both components by constructing the post member to have an elastic modulus optimized for the horizontal component X and the upper member to have an elastic modulus optimized for the vertical component Y.

The post member consists of a composite material comprising a high compressive strength, electrically insulating material sandwiched between tough outer layers to provide electrical insulation between the rail and the shoulder insert. The composite material is designed to place wear resistant, durably tough material in contact with the adjacent surfaces of the rail and the shoulder insert thereby enhancing the mechanical lifetime of the two-piece insulator spacer of which it is a part. The composite material makes the post member sufficiently electrically insulating so as to operably electrically isolate the rail the insulator spacer is in contact with from the shoulder insert with which the insulator spacer is also in contact. By comprising the entire post area of the insulator spacer, the composite material that makes up the post member carries the entire lateral load that the post area is subjected to in service, thereby maximizing the insulator spacer's resistance to lateral load-induced deterioration.

Morever, the elastic modulus of the post member can be tailored by the selection of the materials comprising the composite material as well as by varying the relative thicknesses of those materials. Thus, for example, where a particular type of steel is selected for the outer layers and a mica-filled phenolic plastic is chosen for the electrically insulating material, the elastic modulus of a composite material of a given overall thickness can be set at any point selected within a significantly wide range by controlling the relative thicknesses of the steel and the mica-filled phenolic plastic. Likewise, if the thickness of each of the layers is selected, then an aim elastic modulus for the composite material can be obtained by properly choosing the layer materials according to their respective elastic moduli.

Thus, described is a fastening system for securing a rail to a concrete railroad tie wherein the concrete railroad tie has a rail seat area on which the rail rests. The fastening system comprises a shoulder insert mounted in the concrete railroad tie adjacent to the rail seat area, a two-piece insulator spacer inserted between the shoulder insert and the rail, and a retaining clip attached to the shoulder insert. The composite material making up the post member of the two-piece insulator spacer is positioned so that it contacts both the shoulder insert and the rail.

Also described is a two-piece insulator spacer having an upper member and also having a post member which consists of a composite material. If desired, nubs or adhesive may be provided for retaining the post member in a cavity of the upper member during the handling of the insulator spacer with the nubs or adhesive becoming inoperative during service of the insulator space; this arrangement allows the insulator spacer to be handled as a single unit prior to service while providing the advantages of independent flexure of the two pieces during service.

Also described is a method of securing a rail to a concrete railroad tie. This method comprises the step of inserting an insulator spacer between a rail and a shoulder insert which is mounted in a concrete railroad tie. The insulator spacer used in this method is of a two-piece construction having a post member consisting of a composite material so that the shoulder insert and the rail each contact the composite material.

Also described is a method of retrofitting a railroad system that has a rail insulated by means of an existing insulator spacer from a shoulder insert which is mounted in a concrete railroad tie. This method comprises the steps of first removing the existing insulator spacer and then inserting between the rail and the shoulder insert a two-piece insulator spacer having a post member consisting of a composite material so that the shoulder insert and the rail each contact the composite material.

Other features and advantages inherent in the subject matter claimed and described will become apparent to those skilled in the art from the following detailed description of presently preferred embodiments thereof and to the appended drawings.

BRIEF DESCRIPTION OF THE DRAWINGS

The criticality of the features and merits of the present invention will be better understood by reference to the attached drawings wherein similar reference characters denote similar elements throughout the several figures. It is to be understood, however, that the drawings are designed for the purpose of illustration only and not as a definition of the limits of the present invention.

DESCRIPTION OF PREFERRED EMBODIMENTS

Figure 1:
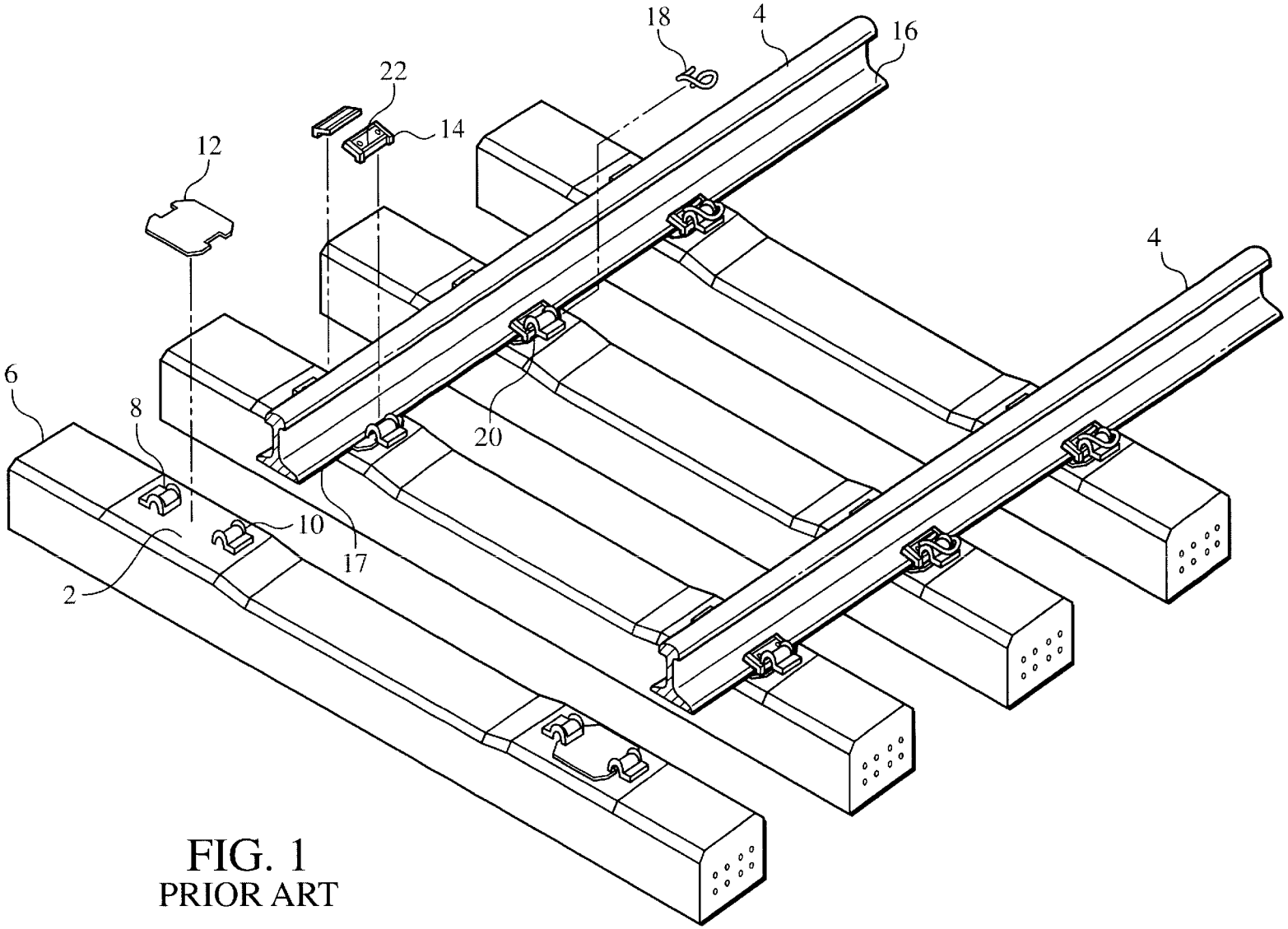
FIG. 1 PRIOR ART
FIG. 1 is a schematic showing an isometric view, partially exploded, of a prior art fastening system for securing rails to concrete railroad ties.
Figure 2A:
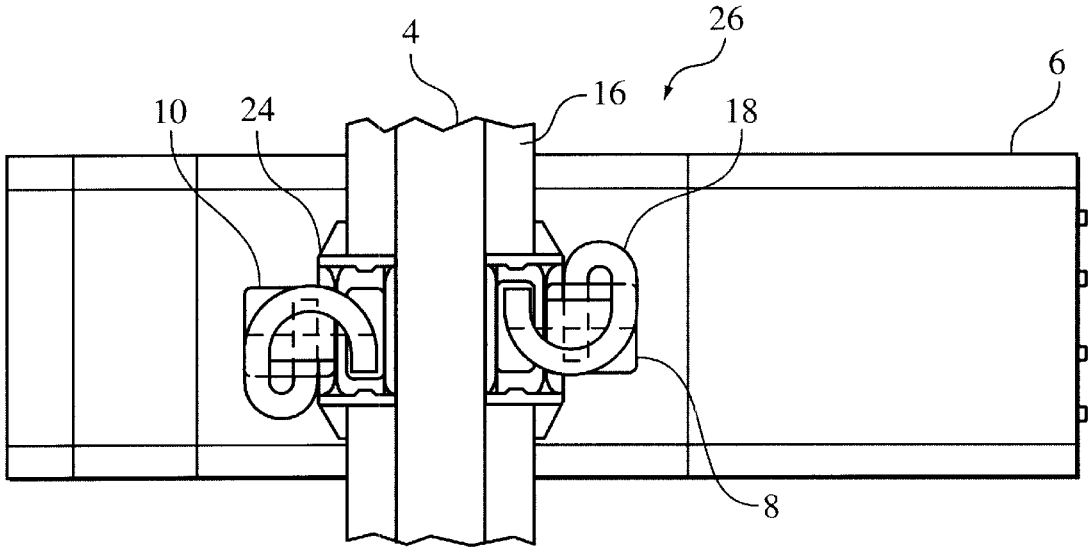
FIG. 2A is a top view, partially in cross-section, of a fastening system according to an embodiment of the present invention.
Figure 2B:
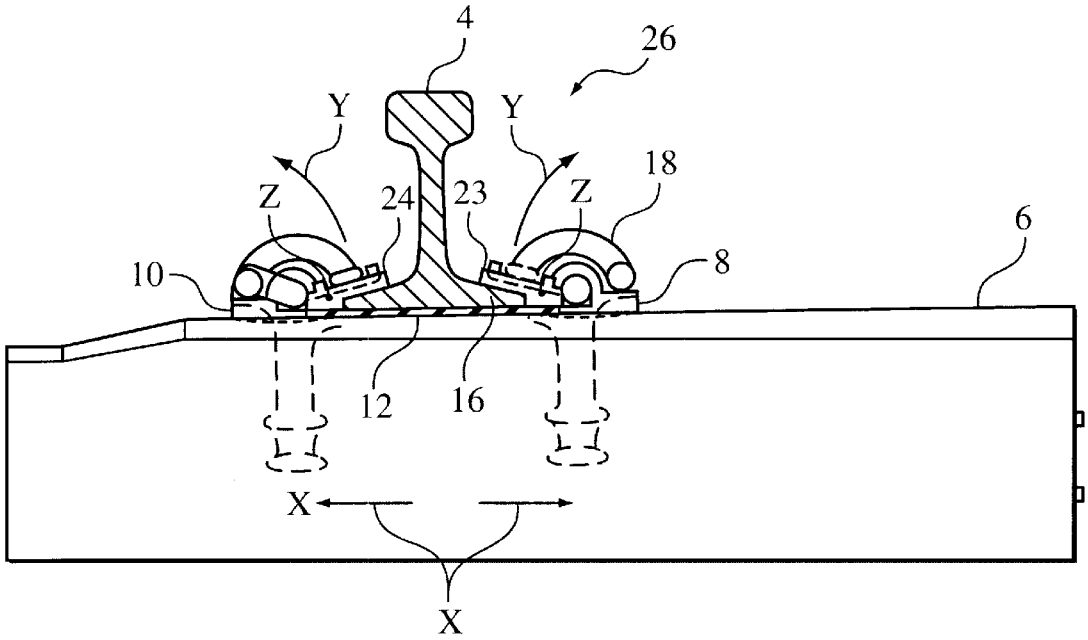
FIG. 2B is a side view of the fastening system illustrated in FIG. 2A.

FIGS. 2A and 2B illustrate an improved fastening system 26 according to the present invention for securing a rail 4 to a concrete railroad tie 6. The improved fastening system 26 shown in FIGS. 2A and 2B includes all of the same components as the prior art fastening system shown in FIG. 1 except that the prior art monolithic insulator spacer 14 has been replaced by the two-piece insulator spacer 24 according to the present invention.

Referring to FIGS. 2A and 2B, in improved fastening system 26, rail 4 is seated upon tie pad 12 and a corresponding retaining clip 18 is attached to each of shoulder inserts 8, 10 and firmly presses a corresponding two-piece insulator spacer 24 against the base 16 of rail 4. These components cooperate to firmly secure rail 4 to concrete railroad tie 6.

Figure 3:
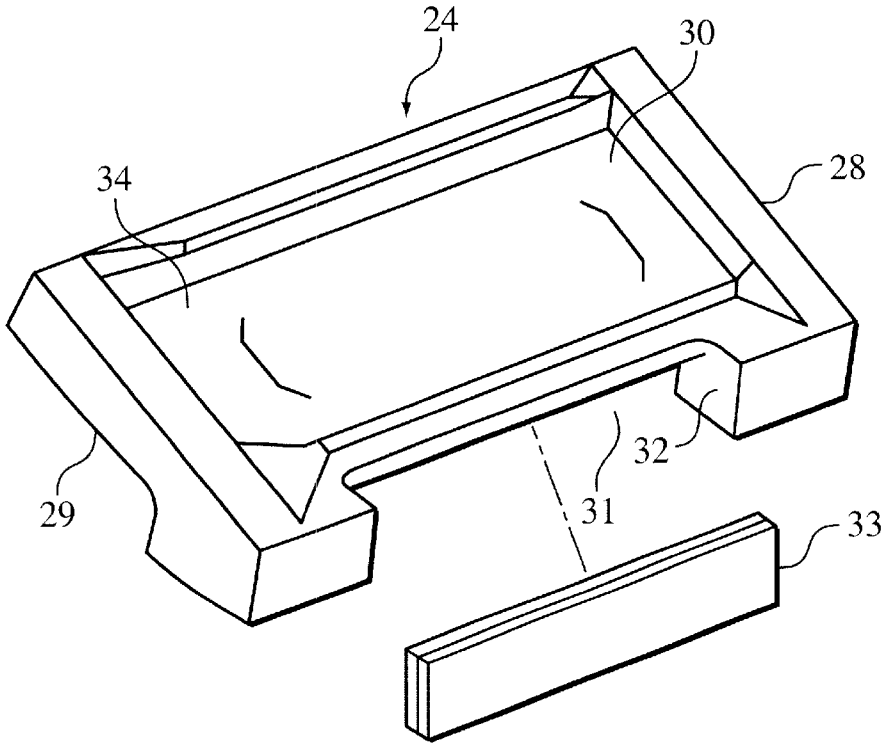
FIG. 3 is an exploded isometric view of an insulator spacer according to one embodiment of the present invention.

A preferred embodiment of the two-piece insulator spacer 24 is shown in FIG. 3. Referring to FIG. 3, the two-piece insulator spacer 24 consists of two separable pieces which are nested together during service. One piece is upper member 28, which has an inner surface 29 that is adapted to conform to the sloping lateral face of the rail base 16. Upper member 28 also has an outer surface 30 which is pressed upon by a retaining clip 18 to clamp upper member 28 against an underlying rail base 16.

The second piece of the two-piece insulator spacer 24 is post member 33. Post member 33 includes the portion of the two-piece insulator spacer 24 that, in service, stands between the shoulder insert 8, 10 and the post face 17 of the rail base 16. Post member 33 consists entirely of a composite material. The composite material is described further below. Post member 33 nests within cavity 31 of upper member 28. This nesting serves to longitudinally and vertically confine post member 33 in service from migrating out of position.

Figure 4A:
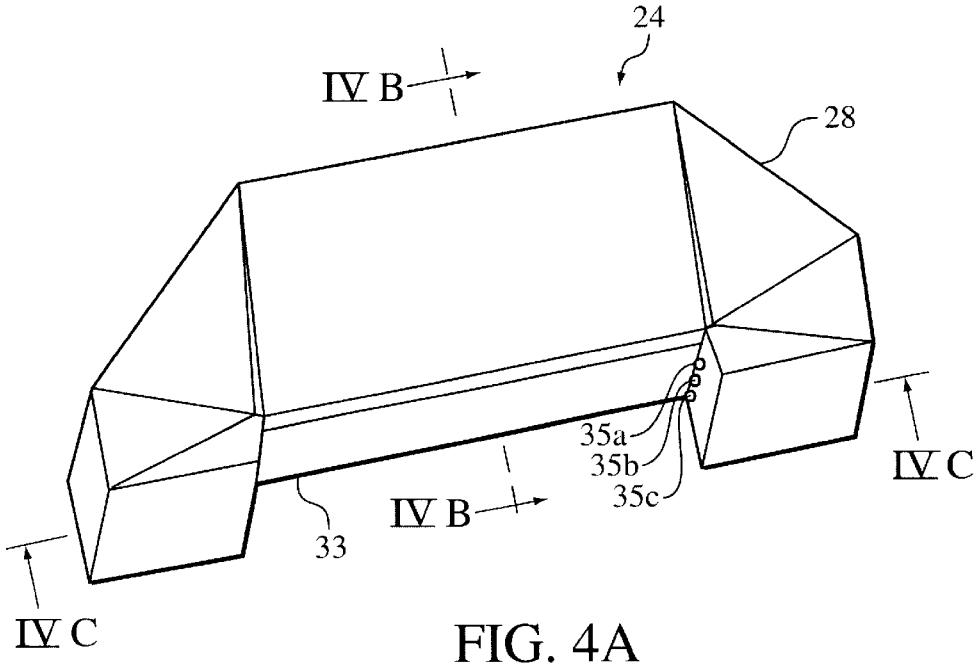
FIG. 4A is an isometric view of an insulator spacer according to an alternative embodiment of the present invention.

FIG. 4A shows an alternative design of a two-piece insulator spacer 24 with post member 33 nested into upper member 28. In this embodiment, small, compressible nubs 35*a*, 35*b*, 35*c*, which protrude from the surface of upper member 28 to hold post member 33 in place horizontally and vertically during the handling of the two-piece insulator spacer 24 as a single assembly prior to its installation. These small nubs 35*a*, 35*b*, 35*c* wear away or otherwise become inoperable during the service of the two-piece insulator spacer 24 due to the relative motion of the upper member 28 and the post member 33 under service loads. Post member 33 may also be temporarily held in place during handling by using a weak adhesive or a water soluble glue to bond post member 33 to upper member 28. Such an adhesive is weak enough to fail when the two-piece insulator spacer 24 is subjected to service loads and water soluble glues will be dissolved by rain so that in either case the post member 33 is released in service from its temporary attachment to upper member 28.

Figure 4B:
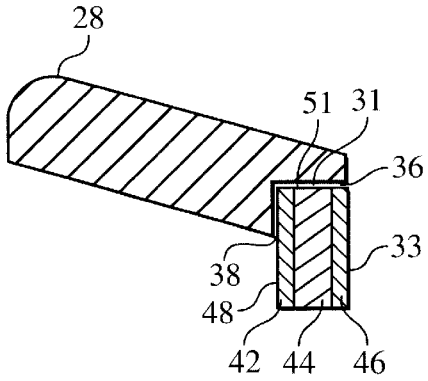
FIG. 4B is a cross sectional view of the insulator spacer shown in FIG. 4A taken along plane IVB—IVB.

FIG. 4B illustrates a cross section of the two-piece insulator spacer 24 taken across plane IVB—IVB in FIG. 4A. Referring to FIG. 4B, post member 33 is seen to loosely nest into the corner of cavity 31 which is defined in part by inner horizontal surface 36 and inner vertical surface 38 of upper member 28. First outer surface 48 of first outer layer 42 of post member 33 contacts inner vertical surface 38 of upper member 28 while a small gap exists between top surface 51 of the post member 33 and the inner horizontal surface 36 of upper member 28.

Figure 4C:
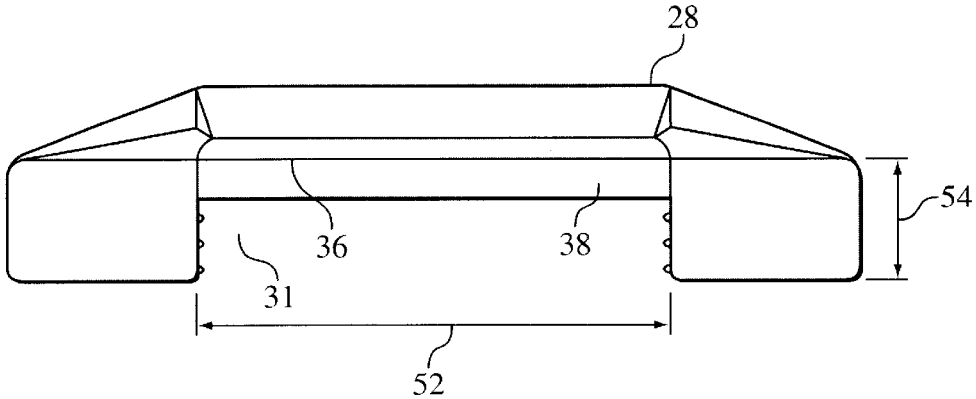
FIG. 4C is an elevational view of the upper member of the insulator spacer shown in FIG. 4A as viewed in direction of arrow IVC.

FIG. 4C shows an elevational view of only upper member 28 as viewed in the direction shown by arrows IVC in FIG. 4A. This view illustrates the longitudinal dimension 52 and vertical dimension 54 of cavity 31. Preferably, post member 33 is sized so that its longitudinal and vertical dimensions are smaller than the corresponding longitudinal and vertical dimensions 52, 54 of cavity 31 by about 1/64 (0.04 cm) to about 1/32 inch (0.08 cm). This slight undersizing of the post member 33 allows for sufficient independent flexing of the upper member 28 and the post member 33 while enabling the upper member 28 to confine the vertical and longitudinal migration of the post member 33 during service.

Figure 6:
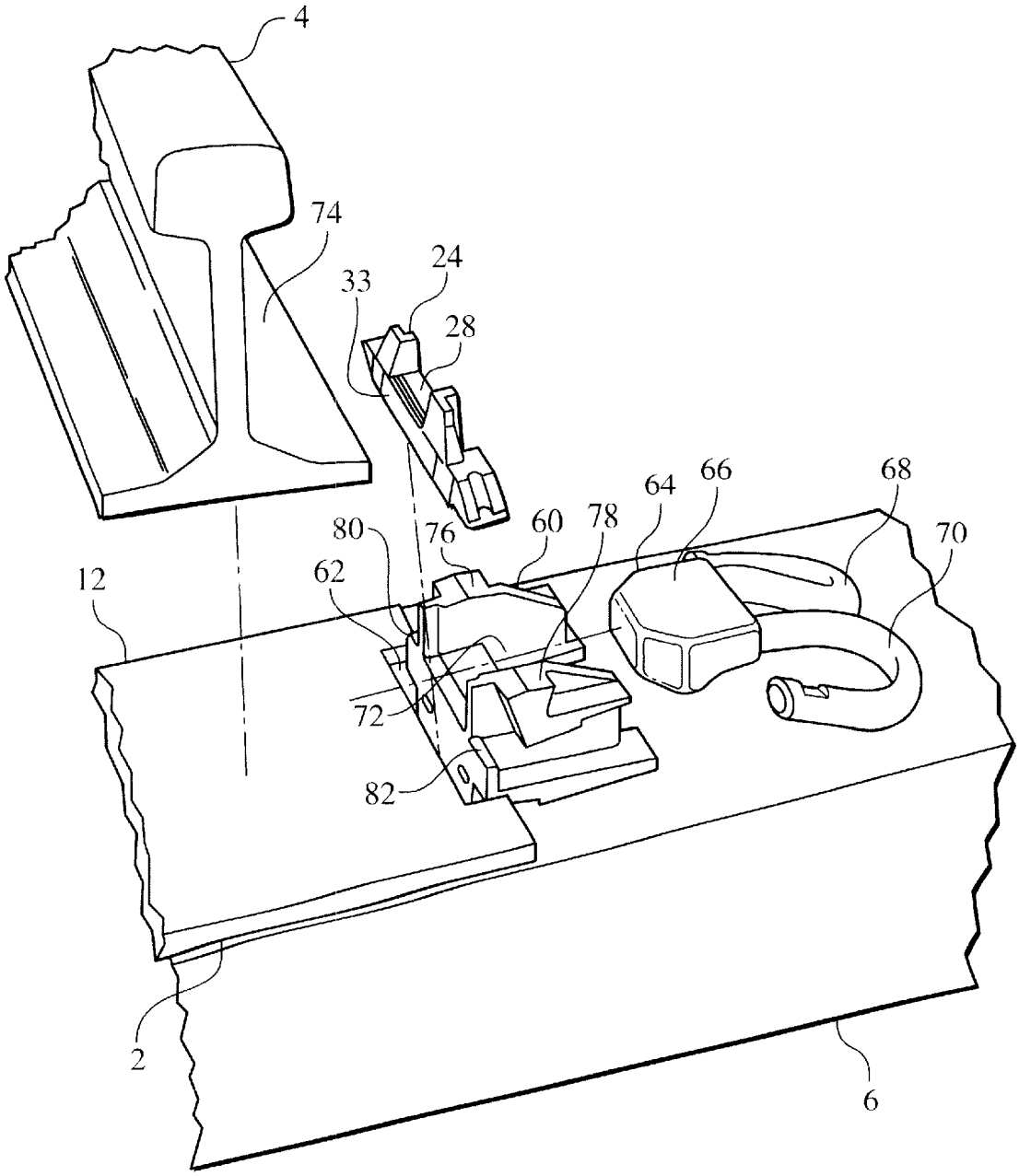
FIG. 6 is a schematic showing an isometric view, partially exploded, of a fastening system for securing rails to concrete railroad ties according to a further alternative embodiment of the present invention.

The overall design of the two-piece insulator spacer 24 may take on a various geometric configurations to conform to the particular designs of the shoulder inserts and retaining clips it is to be used in conjunction with so long as the two-piece insulator spacer 24 is able to perform its spacing and electrical insulating functions. For example, referring to FIG. 3, upper member 28 may include pockets, for example, retaining clip receiving pocket 34, or may cooperate with upper member 28 to form a pocket, for example, shoulder insert receiving pocket 32. The two-piece insulator spacer 24 may have angular and tapered outlines and surfaces as shown in FIG. 4 or may take on any other desired configuration. FIG. 6 shows an alternative embodiment of the two-piece insulator spacer 24 which is suitable for use in the system depicted in FIG. 6.

Upper member 28 may be made of any durable insulating material known to one skilled in the art having a suitably high compression strength for the application. Such materials include materials which are commonly used for conventional insulator spacers. However, materials having lower compression strength than is necessary for conventional insulator spacers may also be used because upper member 28 is not subjected to the same high level of laterally-directed compressive forces as are the post sections of conventional insulator spacers. Preferably, upper member 28 comprises 6-6 nylon.

Upper member 28 may be selected to have an elastic modulus that is preferably within the range of from about 230,000 (1,600 MPa) to about 700,000 pounds per square inch (4,800 MPa). More preferably, upper member 28 is selected to have an elastic modulus that is optimized to best accommodate the vertical flexural component Y for the particular application in which the two-piece insulator spacer 24 is to be used.

Post member 33 comprises a composite material that is designed to place a wear resistant, durably tough material in contact with the adjacent surfaces of the rail 4 and the shoulder insert 8, 10 thereby enhancing the mechanical lifetime of the two-piece insulator spacer. A high compressive strength, electrically insulating material is sandwiched between the outer layers of the composite material to provide electrical insulation between the rail 4 and the shoulder insert 8, 10.

Figure 5:
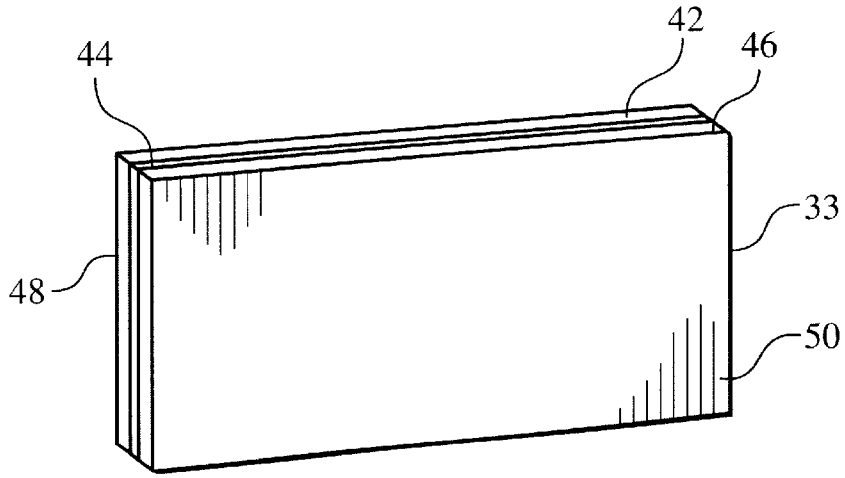
FIG. 5 is an isometric view of the post member shown in the embodiment illustrated in FIG. 3.

FIG. 5 illustrates the post member 33 of the embodiment of the two-piece insulator spacer 24 shown in FIG. 3. Referring to FIG. 5, the composite material of post member 33 is shown to consist of three layers: first outer layer 42, insulating layer 44, and second outer layer 46. In service, first and second outer surfaces 48, 50 of post member 33 are in contact with, respectively, the post face 17 of the rail base 16 and the rail-facing surface of the shoulder insert 8, 10. First and second outer layers 42, 46 are made of a wear resistant, durably tough material, preferably a steel having a tensile strength of greater than about 55,000 pounds per square inch (379 MPa), more preferably made of a steel having a yield strength of between about 20,000 (138 MPa) and about 30,000 pounds per square inch (207 MPa), and most preferably made of a steel having a yield strength of between about 24,000 (165 MPa) and about 30,000 pounds per square inch (207 MPa). Examples of suitable steels are ASTM A283-58 Grade A steel and ASTM A285-57T Grade A steel. Other steels or other materials may be used for the first and second outer layers 42, 46 so long as the material used is not brittle, has wear compatability with the surface of the shoulder insert 8, 10 or the rail 4 it contacts in service, and provides a compression fatigue lifetime to post member 33 that is substantially longer under service conditions than that of 6-6 nylon. First and second layers 42, 46 may be made of the same material or of different materials.

Insulating layer 44 is comprised of an electrically insulating material, for example without limitation, a high compression strength plastic or ceramic. Preferably, the electrically insulating material is a mica-filled phenolic plastic such as a Formica® material, which is available from the Formica Corporation, 10155 Reading Road, Cincinnati, Ohio 45241. Other examples of suitable plastics are filled nylons such as a Nylatron® material, which is available from DSM Engineering Plastic Products, 2120 Fairmont Avenue, Reading, Pa., U.S., 19612-4235, and fiberglass-reinforced polyphenylene sulfide compounds such as a Ryton® material, which is available from Chevron Phillips Chemical Co., Specialty Chemicals and Specialty Plastics, P.O. Box 7777, Bartlesville, Okla., U.S. 74005-7777. As discussed herein below, the insulating layer 44 may comprise an epoxy. Suitable ceramics include without limitation aluminum oxide and silicon nitride.

Although the composite material is shown in FIG. 5 as having three layers, it may have any number of layers so long as the layers in contact with the surfaces of the rail and the shoulder insert are made of wear resistant, durably tough material and so long as there is one or more insulating layers that cause the composite material to be an electrical insulator capable of electrically isolating the rail 4 from the shoulder insert 8, 10. The thickness of each layer will depend on the number of layers used, the particular materials used for each layer, and the overall thickness of the composite material. A layer may have a thickness that is the same or different from that of another layer or layers. When it is desired to optimize the mechanical properties of the composite material without regard to its elastic modulus, the thickness of the insulating layer or layers are minimized and the thicknesses of the durably tough material layers are maximized.

For example, for a three-layer composite material such as that shown in FIG. 5 having steel as the outer layers 42, 46 and a mica-filled phenolic plastic as the insulating layer 44, it is preferred that the insulating layer 44 have a thickness of about one-half of that of each of the outer layers 42, 46. Thus, for a composite material having an overall thickness of about 5/16 inches (0.8 cm), the thickness of each of the outer layers 42, 46 is preferably about 1/8 inch and the thickness of the insulator layer 44 is about 1/16 inch (0.16 cm).

The elastic modulus of the post member 33 is preferably within the range of from about $1.93\times10^6$ (13,310 MPa) to about $10.4\times10^6$ pounds per square inch (71,724 MPa). The elastic modulus of the post member 33 may be optimized for a particular application by designing the composite material that it consists of to have a selected elastic modulus that best accommodates the horizontal flexural component X for the application in which the two-piece insulator spacer 24 is to be used. Designing the composite material to have such a selected elastic modulus is accomplished by selecting the materials and the thicknesses of the various layers of the composite material with the goal of obtaining the selected elastic modulus value for the composite material. Note that the overall thickness of the composite material is determined by the space between the rail 4 and the shoulder insert 8, 10. The inventors have discovered that the elastic modulus for the composite material, $E_{composite}$, is determined by the following formula:

$$E_{composite}=1/(t/E_A+(1-t)/E_B)$$

where:

t is the portion of the overall thickness of the composite that is made up of the durable material layers;

(1−t) is the portion of the overall thickness of the composite that is made of insulating material layer or layers;

$E_A$ is the average elastic modulus of the durable material layers; and $E_B$ is the average elastic modulus of the insulating material layer or layers.

This formula is preferably employed in the designing of a composite material for the post member 33 to have a selected elastic modulus. For example, Table 1 gives values, according to the formula, of the elastic modulus for the composite material, $E_{composite}$, for a three-layer composite material wherein a plastic of having an elastic modulus of either $1.0\times10^6$ (6,895 MPa) or $2.9\times10^6$ pounds per square inch (19,995 MPa) comprises the insulating layer 44 and steel having an elastic modulus of $29\times10^6$ pounds per square inch (199,950 MPa) comprises the first and second outer layers 42, 46. Note that the elastic modulus of the composite material, $E_{composite}$, can be set within a wide range of values by appropriate selections of the proportional thicknesses and elastic moduli of the durable material layers and the insulating layer or layers.

TABLE 1

| Example No | t | $E_A$ $10^6$ psi (MPa) | 1-t | $E_B$ $10^6$ psi (MPa) | $E_{composite}$ $10^6$ psi (MPa) |
|---|---|---|---|---|---|
| 1 | 0.2 | 29 (199,950) | 0.8 | 1.0 (6,895) | 1.24 (8,550) |
| 2 | 0.2 | 29 (199,950) | 0.8 | 2.9 (19,995) | 3.54 (24,408) |
| 3 | 0.5 | 29 (199,950) | 0.5 | 1.0 (6,895) | 1.93 (13,307) |
| 4 | 0.5 | 29 (199,950) | 0.5 | 2.9 (19,995) | 5.27 (36,336) |
| 5 | 0.8 | 29 (199,950) | 0.2 | 1.0 (6,895) | 4.4 (30,337) |
| 6 | 0.8 | 29 (199,950) | 0.2 | 2.9 (19,995) | 10.4 (71,706) |

The layers of the composite material may be bonded together by an epoxy or urethane or by other suitable bonding materials known to those skilled in the art. The bonding material used preferably has a compression strength that is at least as great as that of the lowest compression strength layer of the composite insert. Examples of suitable bonding materials include epoxies such as Concresive® epoxy, which available from ChemRex, Inc., 889 Valley Park Drive, Shakopee, Minn., U.S., 55379, and Polybac1605 epoxy, which is available from Polygem, Inc., 1105 Carolina Drive, West Chicago, Ill., U.S., 60185. Although there is no restriction on the thickness of the interlayer bonding material, preferably, the bonding material thicknesses are on the order of 0.005 inches (0.013 cm).

In some embodiments of the invention, epoxy is used as an insulating layer 44. In cases where no other insulating layer 44 but epoxy is used, it is preferred for the epoxy to have an elastic modulus of at least about 350,000 pounds per square inch (2,410 MPa), although epoxies with lower elastic moduli may be used. In such cases, it is also preferred that the thickness of the epoxy be determined by means of the foregoing equation according to the desired elastic modulus for the composite.

The two-piece insulator spacer 24 may be used in a method of securing a rail to a concrete railroad tie. This method comprises the step of inserting the two-piece insulator spacer 24 between a rail 4 and a shoulder insert 8, 10 which is mounted in a concrete railroad tie 6. The insertion is done in a manner that places the composite material that comprises the post member 33 of the two-piece insulator spacer 24 in contact with rail 4 and shoulder insert 8, 10. After the two-piece insulator spacer 24 is so inserted, a retaining clip 18 may be attached to the shoulder insert 8, 10 to secure the rail 4 to the concrete railroad tie 6.

Similarly, the two-piece insulator spacer 24 may also be used in a method of retrofitting a railroad system utilizing concrete railroad ties 6 that has a rail 4 insulated by means of an existing insulator spacer from a shoulder insert 8, 10. The existing insulator spacer may be any type of insulator spacer, including an insulator spacer 24. This method comprises the steps of first removing the existing insulator spacer and then inserting between the rail 4 and the shoulder insert 8, 10 a two-piece insulator spacer 24. The insertion is done in a manner that places the composite material that is located in the post member 33 of the two-piece insulator spacer 24 in contact with rail 4 and shoulder insert 8, 10. After the two-piece insulator spacer 24 is so inserted, a retaining clip 18 may be attached to the shoulder insert 8, 10 to secure the rail 4 to the concrete railroad tie 6.

It is to be understood that the two-piece insulator spacers, fastening systems, methods of securing a rail to a concrete railroad tie, and methods of retrofitting encompassed by the present invention are not limited to the particular configurations of the components described in the embodiments discussed above. Rather, the two-piece insulator spacers, fastening systems, methods of securing a rail to a concrete railroad tie, and methods of retrofitting encompassed by the present invention are adaptable for use with all component configurations known to those skilled in the art. For example, FIG. 6 shows a fastening system according to another embodiment of the present invention which employs component configurations which differ in some respects from those previously described herein. In particular, in the shown embodiment, the shoulder insert, the clip, and the insulator spacer are configured so that the clip is inserted perpendicular to the rail rather than parallel to the rail as was the case in the previously described embodiments.

Referring to FIG. 6, rail 4 seats upon tie pad 12 which is situated in rail seat area 2 adjacent to shoulder insert 60. The two-piece insulator spacer 24 inserts between rail 4 and shoulder insert 60 and extends downwardly into gap 62 between tie pad 12 and shoulder insert 60 to rest upon concrete railroad tie 6. When so positioned, the composite material that comprises post member 33 of the two-piece insulator spacer 24 contacts both rail 4 and shoulder insert 60. Insulated clip 64, which comprises insulator portion 66 and first and second hooks 68, 70, is inserted into shoulder insert 60 so that insulator portion 66 passes through shoulder insert throat 72 to contact sloping lateral face 74 of rail 4 and so that first and second hooks 68, 70, respectively, become locked between first and second arms 76, 78 and first and second ears 80, 82. With insulated clip 64 so attached to shoulder insert 60, rail 4 becomes secured to concrete railroad tie 6. A similar arrangement of components may be used on the side of rail 4 which is opposite shoulder insert 60.

While only a few presently preferred embodiments of the invention are described, it is to be distinctly understood that the invention is not limited thereto, but may be otherwise embodied and practiced within the scope of the following claims.

What is claimed is:

1. A system for securing a rail to a concrete railroad tie, said concrete railroad tie having a rail seat area on which said rail rests, the system comprising:

a) a shoulder insert mounted in said concrete railroad tie adjacent to said rail seat area;

b) an insulator spacer inserted between said shoulder insert and said rail, said insulator spacer comprising i) an upper member having a cavity; and ii) a post member nesting within the cavity of said upper member and contacting said shoulder insert and said rail, said post member consisting of a composite material, wherein said composite material comprises a plurality of layers and wherein said plurality of layers includes an electrically insulating layer located between a first outer layer and a second outer layer; and c) a retaining clip attached to said shoulder insert;

whereby said rail is secured to said concrete railroad tie.

2. The system according to claim 1, wherein at least one of said first and second outer layers comprises steel.

3. The system according to claim 2, wherein at least one of said first and second outer layers comprises steel having a tensile strength of at least about 55,000 pounds per square inch (379 MPa).

4. The system according to claim 2, wherein at least one of said first and second outer layers comprises steel having a yield strength of between about 20,000 (138 MPa) and about 30,000 pounds per square inch (207 MPa).

5. The system according to claim 2, wherein at least one of said first and second outer layers comprises steel selected from the group consisting of ASTM A283-58 Grade A steel and ASTM A285-57T Grade A steel.

6. The system according to claim 1, wherein said electrically insulating layer comprises a mica-filled phenolic plastic.

7. The system according to claim 1, wherein said electrically insulating layer comprises a plastic selected from the group consisting of a filled nylon, a fiberglass-reinforced polyphenylene sulfide compound, and an epoxy.

8. The system according to claim 1, wherein said electrically insulating layer comprises a ceramic.

9. The system according to claim 8, wherein said ceramic comprises at least one of aluminum oxide and silicon nitride.

10. The system according to claim 1, wherein said insulator spacer comprises a means for retaining said post member in said cavity during handling of said insulator spacer, said means becoming inoperative during service of said insulator spacer.

11. The system according to claim 1, wherein a thickness of said electrically insulating layer is less than a thickness of at least one of said first and second outer layers.

12. The system according to claim 1, wherein at least two layers of said plurality of layers of said composite material are bonded together by a bonding material.

13. The system according to claim 12, wherein said bonding material comprises at least one of an epoxy and a urethane.

14. The system according to claim 1, wherein said post member has an elastic modulus within the range of from about $1.93\times10^6$ (13,310 MPa) to about $10.4\times10^6$ pounds per square inch (71,724 MPa).

15. The system according to claim 1, wherein said upper member has an elastic modulus within the range of from about 230,000 (1,600 MPa) to about 700,000 pounds per square inch (4,800 MPa).

16. The system according to claim 1, wherein said upper member comprises 6-6 nylon.

17. The system according to claim 1, wherein said insulator spacer includes a pocket for receiving at least one of said shoulder insert and said retaining clip.

18. The system according to claim 1, wherein at least one of the longitudinal dimension and the vertical dimension of said post member is smaller than the corresponding dimension of said cavity by an amount in the range of about 1/64 (0.04 cm) to about 1/32 inch (0.08 cm).

19. An insulator spacer for insertion between a rail and a shoulder insert mounted in a concrete railroad tie, the insulator spacer comprising:

a) an upper member having a cavity; and b) a post member nesting within the cavity of said upper member and consisting of a composite material, wherein said composite material comprises a plurality of layers and wherein said plurality of layers includes an electrically insulating layer located between a first outer layer and a second outer layer.

20. The insulator spacer according to claim 19, wherein at least one of said first and second outer layers comprises steel.

21. The insulator spacer according to claim 20, wherein at least one of said first and second outer layers comprises steel having a tensile strength of at least about 55,000 pounds per square inch (379 MPa).

22. The insulator spacer according to claim 20, wherein at least one of said first and second outer layers comprises steel having a yield strength of between about 20,000 (138 MPa) and about 30,000 pounds per square inch (207 MPa).

23. The insulator spacer according to claim 20, wherein at least one of said first and second outer layers comprises steel selected from the group consisting of ASTM A283-58 Grade A steel and ASTM A285-57T Grade A steel.

24. The insulator spacer according to claim 19, wherein said electrically insulating layer comprises a mica-filled phenolic plastic.

25. The insulator spacer according to claim 19, wherein said electrically insulating layer comprises a plastic selected from the group consisting of a filled nylon, a fiberglass-reinforced polyphenylene sulfide compound, and an epoxy.

26. The insulator spacer according to claim 19, wherein said electrically insulating layer comprises a ceramic.

27. The insulator spacer according to claim 26, wherein said ceramic comprises at least one of aluminum oxide and silicon nitride.

28. The insulator spacer according to claim 19, wherein said insulator spacer comprises a means for retaining said post member in said cavity during handling of said insulator spacer, said means becoming inoperative during service of said insulator spacer.

29. The insulator spacer according to claim 19, wherein a thickness of said electrically insulating layer is less than a thickness of at least one of said first and second outer layers.

30. The insulator spacer according to claim 19, wherein at least two layers of said plurality of layers of said composite material are bonded together by a bonding material.

31. The insulator spacer according to claim 30, wherein said bonding material comprises at least one of an epoxy and a urethane.

32. The insulator spacer according to claim 19, wherein said post member has an elastic modulus within the range of from about $1.93\times10^6$ (13,310 MPa) to about $10.4\times10^6$ pounds per square inch (71,724 MPa).

33. The insulator spacer according to claim 19, wherein said upper member has an elastic modulus within the range of from about 230,000 (1,600 MPa) to about 700,000 pounds per square inch (4,800 MPa).

34. The insulator spacer according to claim 19, wherein said upper member comprises 6-6 nylon.

35. The insulator spacer according to claim 19, wherein said insulator spacer includes a pocket for receiving at least one of said shoulder insert and said retaining clip.

36. The insulator spacer according to claim 19, wherein at least one of the longitudinal dimension and the vertical dimension of said post member is smaller than the corresponding dimension of said cavity by an amount in the range of about 1/64 (0.04 cm) to about 1/32 inch (0.08 cm).

37. A method of securing a rail to a concrete railroad tie, said concrete railroad tie having a rail seat area upon which said rail rests, the method comprising the step of inserting an insulator spacer between a shoulder insert and said rail, said shoulder insert being mounted in said concrete railroad tie adjacent said rail seat area, and said insulator spacer having a) an upper member having a cavity; and b) a post member nesting within the cavity of said upper member and consisting of a composite material, wherein said composite material comprises a plurality of layers and wherein said plurality of layers includes an electrically insulating layer located between a first outer layer and a second outer layer;

wherein said inserting causes said shoulder insert and said rail each to contact said post member.

38. The method according to claim 37, further comprising the step of attaching a retaining clip to said shoulder insert.

39. The method according to claim 37, wherein at least one of said first and second outer layers comprises steel.

40. The method according to claim 39, wherein at least one of said first and second outer layers comprises steel having a tensile strength of at least about 55,000 pounds per square inch (379 MPa).

41. The method according to claim 39, wherein at least one of said first and second outer layers comprises steel having a yield strength of between about 20,000 (138 MPa) and about 30,000 pounds per square inch (207 MPa).

42. The method according to claim 39, wherein at least one of said first and second outer layers comprises steel selected from the group consisting of ASTM A283-58 Grade A steel and ASTM A285-57T Grade A steel.

43. The method according to claim 37, wherein said electrically insulating layer comprises a mica-filled phenolic plastic.

44. The method according to claim 37, wherein said electrically insulating layer comprises a plastic selected from the group consisting of a filled nylon, a fiberglass-reinforced polyphenylene sulfide compound, and an epoxy.

45. The method according to claim 37, wherein said electrically insulating layer comprises a ceramic.

46. The method according to claim 45, wherein said ceramic comprises at least one of aluminum oxide and silicon nitride.

47. The method according to claim 37, wherein said insulator spacer comprises a means for retaining said post member in said cavity during handling of said insulator spacer, said means becoming inoperative during service of said insulator spacer.

48. The method according to claim 37, wherein a thickness of said electrically insulating layer is less than a thickness of at least one of said first and second outer layers.

49. The method according to claim 37, wherein at least two layers of said plurality of layers of said composite material are bonded together by a bonding material.

50. The method according to claim 49, wherein said bonding material comprises at least one of an epoxy and a urethane.

51. The method according to claim 37, wherein said post member has an elastic modulus within the range of from about $1.93\times10^6$ (13,310 MPa) to about $10.4\times10^6$ pounds per square inch (71,724 MPa).

52. The method according to claim 37, wherein said upper member has an elastic modulus within the range of from about 230,000 (1,600 MPa) to about 700,000 pounds per square inch (4,800 MPa).

53. The method according to claim 37, wherein said upper member comprises 6-6 nylon.

54. The method according to claim 3, wherein said insulator spacer includes a pocket for receiving at least one of said shoulder insert and said retaining clip.

55. The method according to claim 38, wherein at least one of the longitudinal dimension and the vertical dimension of said post member is smaller than the corresponding dimension of said cavity by an amount in the range of about 1/64 (0.04 cm) to about 1/32 inch (0.08 cm).

56. A method of retrofitting a railroad system having a rail insulated from a shoulder insert mounted in a concrete railroad tie by a first insulator spacer, the method comprising the steps of:

a) removing said first insulator spacer; and b) inserting a second insulator spacer between said shoulder insert and said rail, said second insulator spacer having i) an upper member having a cavity; and ii) a post member nesting within the cavity of said upper member and consisting of a composite material, wherein said composite material comprises a plurality of layers and wherein said plurality of layers includes an electrically insulating layer located between a first outer layer and a second outer layer;

wherein said inserting causes said shoulder insert and said rail each to contact said post member.

57. The method according to claim 56, further comprising the step of attaching a retaining clip to said shoulder insert.

58. The method according to claim 56, wherein at least one of said first and second outer layers comprises steel.

59. The method according to claim 58, wherein at least one of said first and second outer layers comprises steel having a tensile strength of at least about 55,000 pounds per square inch (379 MPa).

60. The method according to claim 58, wherein at least one of said first and second outer layers comprises steel having a yield strength of between about 20,000 (138 MPa) and about 30,000 pounds per square inch (207 MPa).

61. The method according to claim 59, wherein at least one of said first and second outer layers comprises steel selected from the group consisting of ASTM A283-58 Grade A steel and ASTM A285-57T Grade A steel.

62. The method according to claim 56, wherein said electrically insulating layer comprises a mica-filled phenolic plastic.

63. The method according to claim 56, wherein said electrically insulating layer comprises a plastic selected from the group consisting of a filled nylon, a fiberglass-reinforced polyphenylene sulfide compound, and an epoxy.

64. The method according to claim 56, wherein said electrically insulating layer comprises a ceramic.

65. The method according to claim 64, wherein said ceramic comprises at least one of aluminum oxide and silicon nitride.

66. The method according to claim 56, wherein said insulator spacer comprises a means for retaining said post member in said cavity during handling of said insulator spacer, said means becoming inoperative during service of said insulator spacer.

67. The method according to claim 56, wherein a thickness of said electrically insulating layer is less than a thickness of at least one of said first and second outer layers.

68. The method according to claim 56, wherein at least two layers of said plurality of layers of said composite material are bonded together by a bonding material.

69. The method according to claim 68, wherein said bonding material comprises at least one of an epoxy and a urethane.

70. The method according to claim 56, wherein said post member has an elastic modulus within the range of from about $1.93\times10^6$ (13,310 MPa) to about $10.4\times10^6$ pounds per square inch (71,724 MPa).

71. The method according to claim 56, wherein said upper member has an elastic modulus within the range of from about 230,000 (1,600 MPa) to about 700,000 pounds per square inch (4,800 MPa).

72. The method according to claim 56, wherein said upper member comprises 6-6 nylon.

73. The method according to claim 57, wherein said insulator spacer includes a pocket for receiving at least one of said shoulder insert and said retaining clip.

74. The method according to claim 56, wherein at least one of the longitudinal dimension and the vertical dimension of said post member is smaller than the corresponding dimension of said cavity by an amount in the range of about 1/64 (0.04 cm) to about 1/32 inch (0.08 cm).

75. A method of making an insulator spacer for use between a rail and a shoulder insert mounted in a concrete railroad tie, the method comprising the steps of:

a) providing an upper member having a cavity;

b) providing a post member consisting of a composite material, wherein said composite material comprises a plurality of layers and wherein said plurality of layers includes an electrically insulating layer located between a first outer layer and a second layer; and c) nesting said post member within the cavity of said upper member.

76. The method of claim 75 further comprising the step of sizing said post member to loosely nest within the cavity of said upper member.

77. The method of claim 76, wherein at least one of the longitudinal dimension and the vertical dimension of said post member is smaller than the corresponding dimension of said cavity by an amount in the range of about 1/64 (0.04 cm) to about 1/32 inch (0.08 cm).

78. The method of claim 75, further comprising the step of selecting said post member to have an elastic modulus within the range of from about $1.93\times10^6$ (13,310 MPa) to about $10.4\times10^6$ pounds per square inch (71,724 MPa).

79. The method of claim 75, further comprising the step of selecting said upper member to have an elastic modulus within the range of from about 230,000 (1,600 MPa) to about 700,000 pounds per square inch (4,800 MPa).

80. The method of claim 75, further comprising the step of designing said composite material to have a selected elastic modulus, $E_{composite}$, wherein said step of designing includes using the formula:

$$E_{composite}=1/(t/E_A+(1-t)/E_B)$$

where t is the portion of the overall thickness of the composite that is made up of the durable material layers;

(1−t) is the portion of the overall thickness of the composite that is made of insulating material layer or layers;

$E_A$ is the average elastic modulus of the durable material layers; and $E_B$ is the average elastic modulus of the insulating material layer or layers.

81. The method of claim 75, further comprising the step of providing a means for retaining said post member in said cavity during handling of said insulator spacer, said means becoming inoperative during service of said insulator spacer.

* * * * *